US010487441B2

(12) United States Patent
Snook et al.

(10) Patent No.: US 10,487,441 B2
(45) Date of Patent: Nov. 26, 2019

(54) LAUNDRY DRYING MACHINE WITH ADJUSTABLE BAFFLE

(71) Applicant: Midea Group Co., Ltd., Beijiao, Shunde, Foshan (CN)

(72) Inventors: Bryan T. Snook, Louisville, KY (US); Christopher G. Hoppe, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 150 days.

(21) Appl. No.: 15/714,708

(22) Filed: Sep. 25, 2017

(65) Prior Publication Data

US 2019/0093278 A1 Mar. 28, 2019

(51) Int. Cl.
*D06F 58/00* (2006.01)
*D06F 58/04* (2006.01)

(52) U.S. Cl.
CPC ..... *D06F 58/04* (2013.01)

(58) Field of Classification Search
USPC ..... 34/241, 108, 109, 126, 318
See application file for complete search history.

(56) References Cited

U.S. PATENT DOCUMENTS

| | | | | |
|---|---|---|---|---|
| 2,771,766 | A | 11/1956 | Dunlap | |
| 3,616,545 | A | 11/1971 | Jacobs | |
| 3,729,834 | A | 5/1973 | Fox | |
| 3,938,260 | A * | 2/1976 | Brenner | D06F 58/04 34/108 |
| 4,137,646 | A | 2/1979 | Fuhring | |
| 6,698,107 | B2 | 3/2004 | Song et al. | |
| 6,837,265 | B2 | 1/2005 | Porter et al. | |
| 2015/0327351 | A1* | 11/2015 | Marchione | H05F 3/02 361/220 |

FOREIGN PATENT DOCUMENTS

| | | | |
|---|---|---|---|
| CN | 2394928 | Y | 9/2000 |
| CN | 104278474 | A | 1/2015 |
| CN | 105862333 | A | 8/2016 |
| EP | 0083302 | A1 | 7/1983 |
| EP | 2434040 | A2 | 3/2012 |
| EP | 2805631 | A1 | 11/2014 |
| JP | 2007135812 | A | 6/2007 |
| JP | 2014104240 | A | 6/2014 |
| KR | 20010046773 | A | 6/2001 |
| KR | 20060010365 | A | 2/2006 |
| KR | 20060115230 | A | 11/2006 |
| KR | 20140084951 | A | 7/2014 |
| WO | 2014102361 | | 7/2014 |

OTHER PUBLICATIONS

International Search Report and Written Opinion issued in Application No. PCT/CN2018/074187 dated Jun. 25, 2018.

* cited by examiner

*Primary Examiner* — John P McCormack
(74) *Attorney, Agent, or Firm* — Middleton Reutlinger

(57) ABSTRACT

An adjustable baffle and method of adjusting the baffle for a laundry machine. A dryer drum may include one or more adjustable baffles that may adjust tumbling characteristics of the clothes within the dryer drum. The adjustable baffles may include one or more flexible members.

17 Claims, 5 Drawing Sheets

LAUNDRY DRYING MACHINE WITH ADJUSTABLE BAFFLE

BACKGROUND

The present embodiments relate to dryer baffles for a laundry drying machine.

Typical dryer baffles are made with a fixed height and/or shape. However, this practice of using a fixed baffle configuration is optimized only for an average load and often does not correspond to the varying size of each load and type of clothes. By varying the baffle angle, one may optimize the height at which the clothing falls away from the drum and through the heated air stream. Thus, there is a need to pivot the baffles within the dryer drum to adjust tumbling characteristics of clothes within the dryer drum.

SUMMARY

In some embodiments of the invention, for example, a dryer drum for a laundry drying machine may comprise a dryer drum having a cylindrical wall. In various embodiments, the cylindrical wall may have a first end and a second end, wherein the first end defines an opening therein. In addition, in some embodiments, the dryer drum may include at least one adjustable baffle attached to the cylindrical wall and may define a baffle angle between the adjustable baffle and the cylindrical wall. In some embodiments, the adjustable baffle may include a longitudinal axis between opposing ends. In various embodiments, at least one adjustable baffle may be adjustable through a range of baffle angles about a pivot axis coincidentally aligned with the longitudinal axis of the at least one adjustable baffle between a first position and one or more second positions thereby adjusting the baffle angle, wherein the tumbling characteristics of clothes within the dryer drum are affected by the baffle angle of the adjustable baffle.

In some embodiments, at least one adjustable baffle may include a base portion and a blade portion, wherein the blade portion may pivot about the pivot axis between the first position and the one or more second positions relative to the base portion. In addition, in various embodiments, the blade portion may include one or more flexible members projecting therefrom. In some embodiments, at least one adjustable baffle may be at least one of manually pivoted or automatically pivoted between the first position and the one or more second positions. In various embodiments, at least one adjustable baffle may be locked in at least one of the first position or the one or more second positions. In some embodiments, the dryer drum may include a plurality of the adjustable baffles, wherein at least one adjustable baffle may be in the first position and another one of the adjustable baffles may be in the one or more second positions. In addition, in various embodiments, the baffle angle of at least one adjustable baffle in the first position may be about 0 degrees to about 90 degrees relative to the cylindrical wall.

In some embodiments, a laundry drying machine may comprise a housing and a dryer drum positioned within the housing, wherein the dryer drum may include a cylindrical wall. In various embodiments, at least one adjustable baffle may be attached to the cylindrical wall of the dryer drum. In some embodiments, at least one adjustable baffle may include a base portion and a blade portion hinged to the base portion about a pivot axis, wherein the blade portion may include a longitudinal axis coincidentally aligned with the pivot axis. In various embodiments, the blade portion may be adapted to have a range of baffle angles about the pivot axis relative to the base portion, wherein the range of baffle angles may include a first position and one or more second positions.

In addition, in various embodiments, the blade portion may include one or more flexible members projecting therefrom. In some embodiments, at least one adjustable baffle may be at least one of manually pivoted or automatically pivoted between the first position and the one or more second positions. In addition, in some embodiments, at least one adjustable baffle may be locked in at least one of the first position or the one or more second positions. In various embodiments, the laundry drying machine may include a plurality of the adjustable baffles, wherein at least one adjustable baffle may be in the first position and another one of the adjustable baffles may be in the one or more second positions. In some embodiments, the laundry drying machine may comprise one or more hinges between the base portion and the blade portion. In various embodiments, the blade portion may include a proximal end adjacent the base portion and a distal end, wherein the one or more hinges may be adjacent the proximal end of the blade portion. Moreover, in some embodiments, the dryer drum may include a first end and a second end, wherein the first end may define an opening therein, and the blade portion may extend substantially from the first end to the second end of the dryer drum.

Other embodiments may include the method of adjusting a baffle angle of a dryer drum baffle for a laundry drying machine comprising the step of providing a dryer drum having a cylindrical wall, wherein the cylindrical wall may have a first end and a second end, wherein the first end may define an opening, and the cylindrical wall may have attached thereto a plurality of adjustable baffles. In some embodiments, the method may include each one of the plurality of adjustable baffles having a longitudinal axis. In various embodiments, the method may include pivoting one or more of the plurality of adjustable baffles relative to the cylindrical wall between a first position and one or more second positions about a pivot axis coincidentally aligned with the longitudinal axis wherein the tumbling characteristics of clothes within the dryer drum may be affected by the first position or the one or more second positions of the one or more adjustable baffles.

In addition, in some embodiments, the method of pivoting one or more of the plurality of adjustable baffles may include at least one of manually pivoting or automatically pivoting between the first position and the one or more second positions. In various embodiments, the method may include the step of locking the one or more of the plurality of adjustable baffles in at least one of the first position or the one or more second positions. In addition, in various embodiments, the method of pivoting one or more of the plurality of adjustable baffles may include pivoting one of the one or more adjustable baffles to the first position and another one of the one or more adjustable baffles to the one or more second positions. In some embodiments, the method may include attaching one or more flexible members to the plurality of adjustable baffles.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described apparatus and techniques within a front-load residential laundry drying machine such as laundry drying machine 10, such as the type that may be used in single-family or multi-family dwellings, or in other similar applications. However, it will be appreciated that the herein-described apparatus and techniques may also be used in connection with other types of laundry drying machines in some embodiments. For example, they may be used in commercial applications in some embodiments. Moreover, they may be used in connection with other laundry drying machines, as well as with various laundry washing machine configurations.

Figure 1:
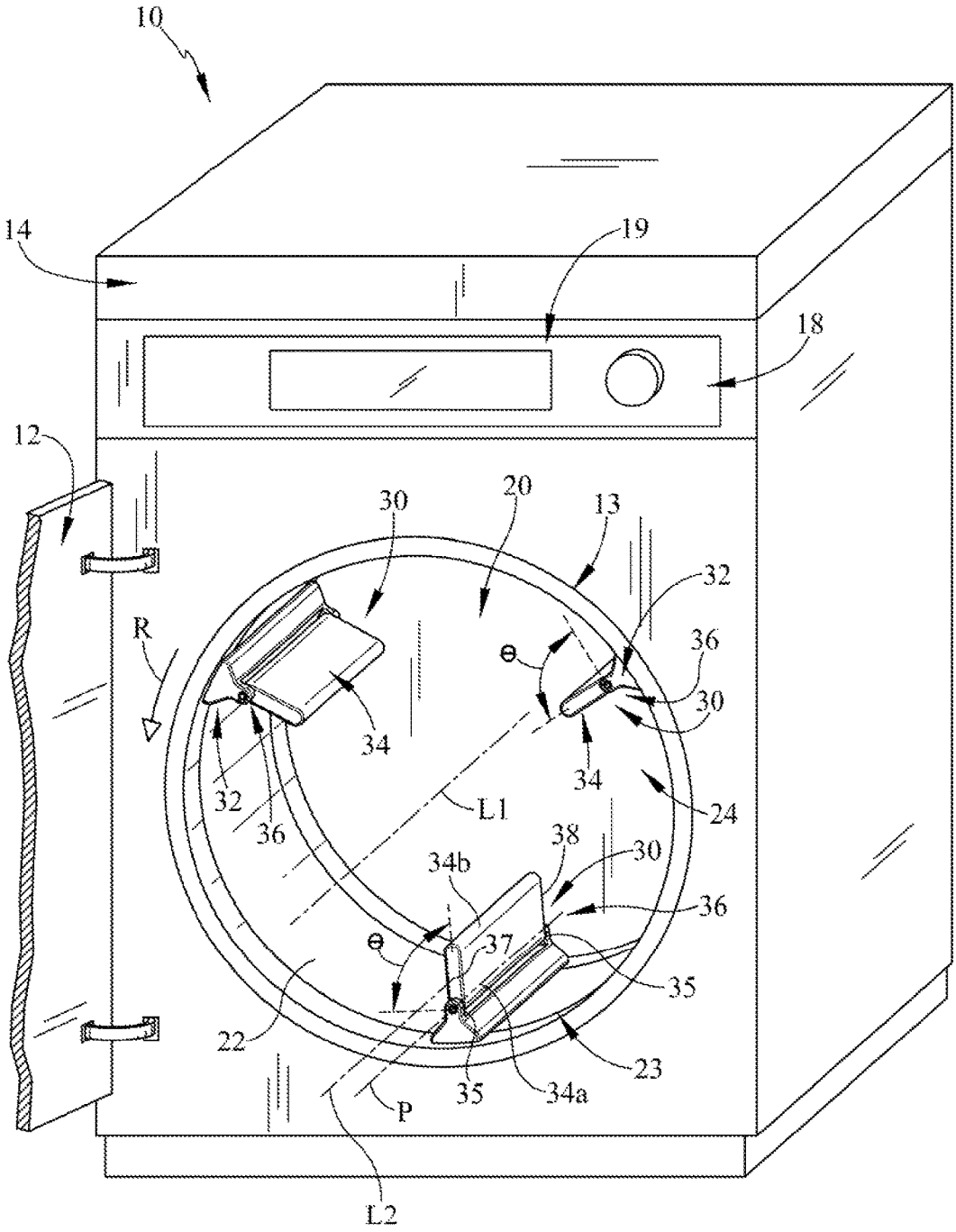
FIG. 1 is a perspective view of one embodiment of an adjustable baffle of the dryer drum illustrating the adjustable baffle in one position having a baffle angle of about 90 degrees relative to a tangent line of the dryer drum, with portions of an embodiment of the laundry drying machine broken away.

Turning now to the drawings, wherein like numbers denote like parts throughout the several views, FIG. 1 illustrates an example laundry drying machine 10 in which the various structures and techniques described herein may be implemented. Laundry drying machine 10 is a front-load drying machine, and as such includes a front-mounted door 12 in a cabinet or housing 14 defining an opening 13 that provides access to a horizontally-oriented dryer drum or basket 20 housed within the cabinet or housing 14. The dryer drum 20 has a first end 23 and a second end 24. Door 12 is generally hinged along a side or front edge and is pivotable between the open position illustrated in FIG. 1 and a closed position (not shown). When door 12 is in the open position, clothes and other dryable items may be inserted into and removed from the dryer drum 20 through the opening 13 in the front of cabinet or housing 14. The dryer drum 20 includes one or more adjustable baffles 30 attached thereto that tilt, or pivot, or otherwise move within the dryer drum to adjust a baffle angle θ. The tumbling characteristics of the clothes within the dryer drum are affected by the corresponding baffle angle of the adjustable baffle. The dryer drum 20, driven by a motor (not shown), may rotate within the housing 14 in a rotational direction R about a longitudinal axis L1. In some embodiments, the motor may be a fixed speed motor or variable speed motor.

Control over laundry drying machine 10 by a user is generally managed through a control panel 18. The control panel 18 may be disposed on one or more surfaces of the machine 10 and may implement a user interface 19. It will be appreciated that in different laundry drying machine designs, control panel 18 may include various types of input and/or output devices, including various knobs, buttons, lights, switches, textual and/or graphical displays, touch screens, etc., through which a user may configure one or more settings, cycles, baffle angles, etc.

Figure 2:
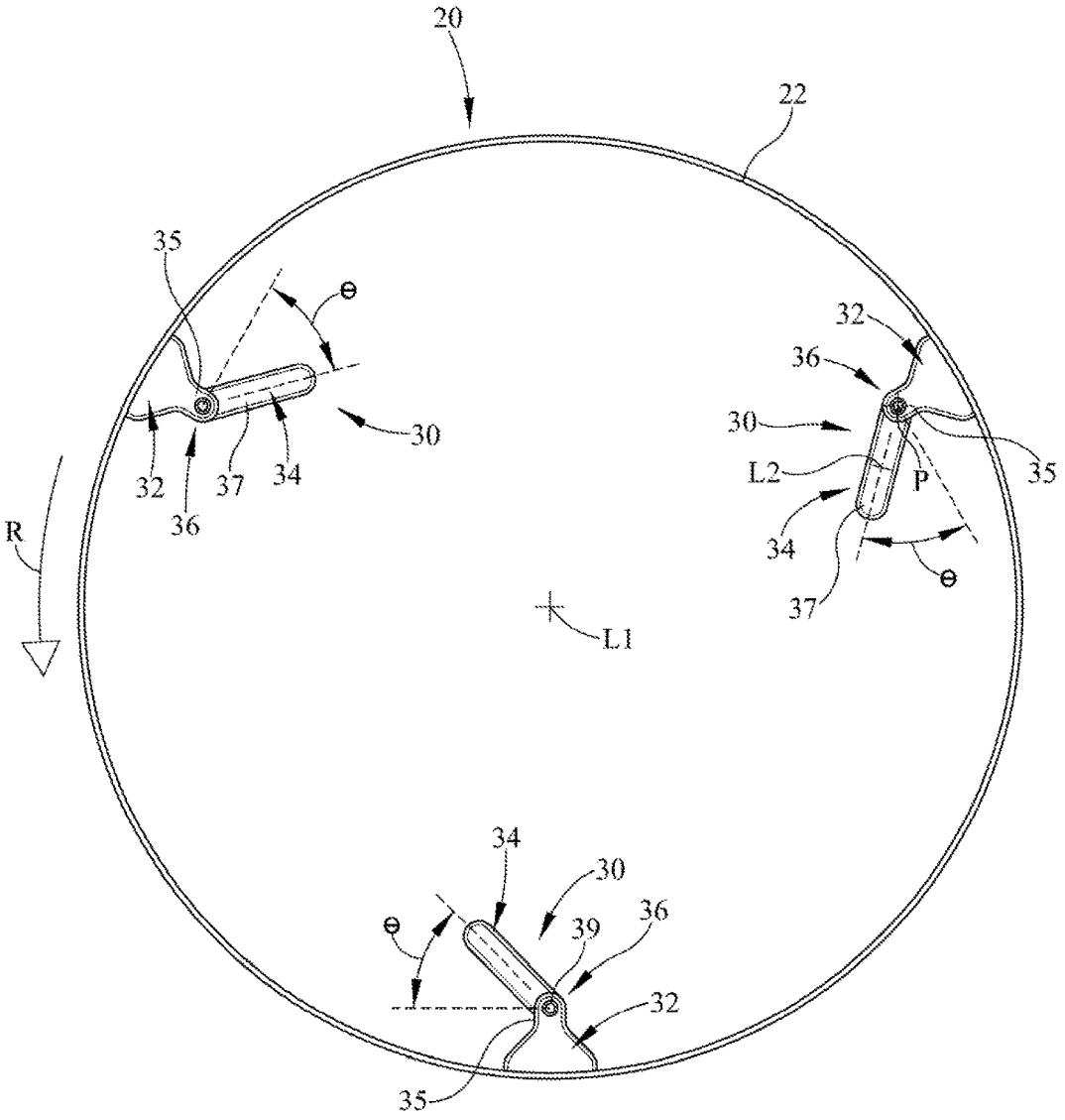
FIG. 2 is a schematic front view through the opening of the dryer drum of FIG. 1 illustrating the adjustable baffle in another position having a baffle angle of about 45 degrees relative to a tangent line of the dryer drum.
Figure 3:
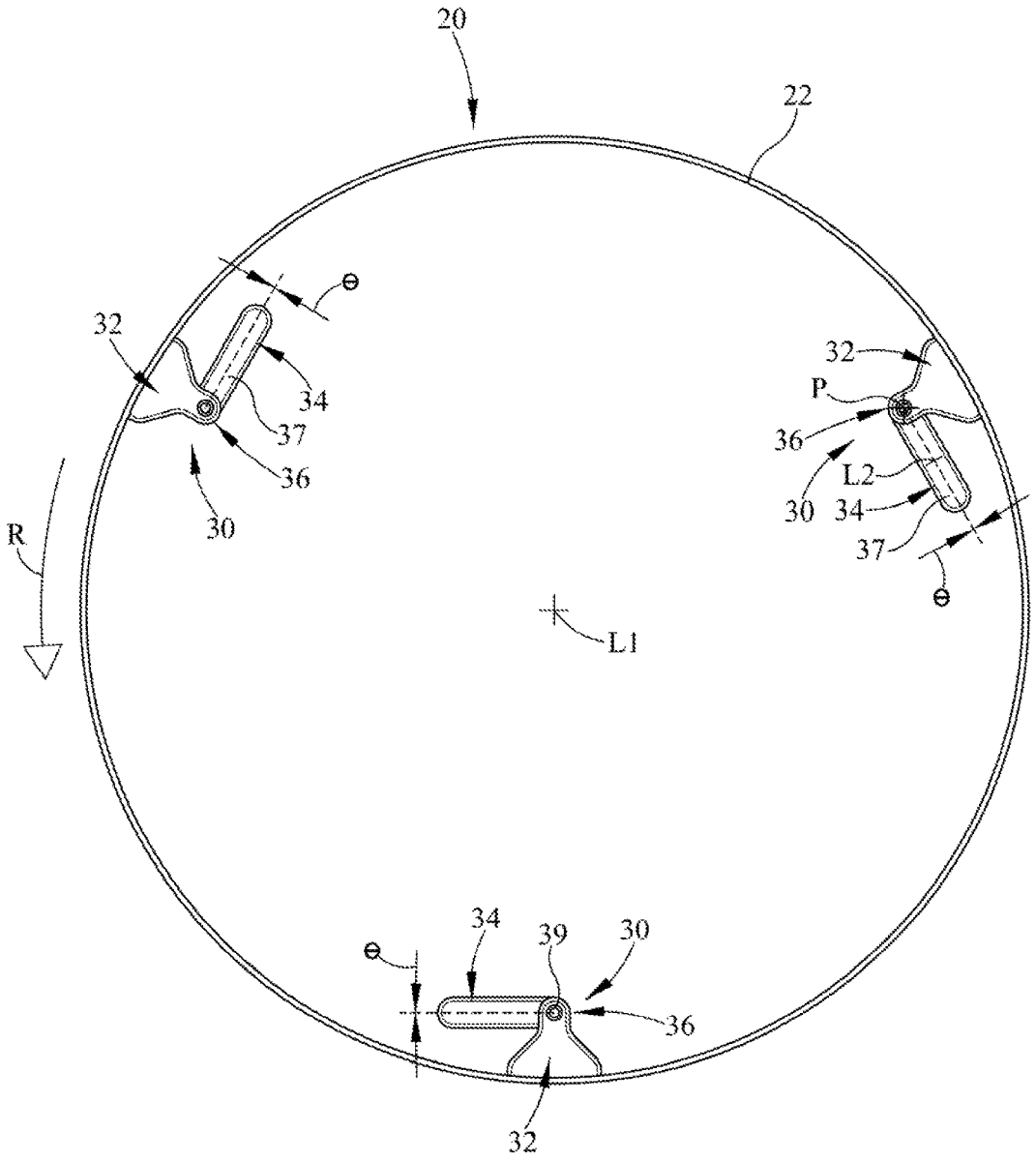
FIG. 3 is a schematic front view through the opening of the dryer drum of FIG. 1 illustrating the adjustable baffle in another position having a baffle angle of about 0 degrees relative to a tangent line of the dryer drum.

One or more adjustable baffles 30 of a plurality of baffles may include an adjustable baffle angle θ relative to the dryer drum 20. It will be understood that this means that the baffle angle θ may be measured relative to a line or plane tangent to the dryer drum 20 at the location of the baffle 30. The adjustable baffle 30 may move between a variety of positions. For example in one embodiment as shown in FIGS. 1-3, a first position (FIG. 1) and one or more second positions (FIGS. 2 and 3). Moreover, in some embodiments, the adjustable baffle 30 may move at least between a first positon and a second position thereby increasing or decreasing the baffle angle θ. In various embodiments, one adjustable baffle 30 may be in a first position and another adjustable baffle 30 may be in a second position that is different from the first position. In some embodiments, the plurality of adjustable baffles 30 may be in the same position and/or have the same baffle angle θ. In some embodiments, a range of movement of the adjustable baffle 30 may be a variety of degrees about a pivot axis P (e.g., about 90 degrees total, 45 degrees total, 15 degrees total, etc.). In the embodiment shown, the range of 90 degrees is from about 0 degrees to about 90 degrees relative to the tangent line of the dryer drum 20. The adjustable baffle 30 may be in a number of positions or increments within one or more overall ranges of movement. A variety of ranges of movement and increments within the range may be used. As shown in FIGS. 1-4, in some embodiments, the adjustable baffle 30 is adjustable through the range of baffle angles θ about the pivot axis P. The adjustable baffle 30 includes a longitudinal axis L2 between the opposing ends 37 and 38. In the embodiment shown, the pivot axis P of the adjustable baffle 30 is coincidentally aligned with the longitudinal axis L2 of the baffle 30 and/or a blade portion 34.

One or more adjustable baffles 30 may pivot in a variety of increments, degrees, or baffle angles θ between two or more positions and still be within the scope of the invention. As illustrated in FIGS. 1-3 in one embodiment, the pivoting increments or angle θ change of the adjustable baffle 30 is substantially about 45 degrees between positions (e.g. 0 degrees, 45 degrees, and 90 degrees) within a range of angle movement. Other increments within the range of movement are obviously possible, including 30 degrees, 15 degrees, or any other angle between positions. As shown in FIG. 1, the adjustable baffles 30 may be substantially 90 degrees from the plane parallel to the tangent plane of the dryer drum 20. In FIG. 2, the baffle angle θ of the adjustable baffles 30 may be substantially 45 degrees from the tangent plane of the dryer drum 20 and/or plane parallel to the tangent plane of the dryer drum 20. Alternatively stated, the adjustable baffle 30 is 45 degrees from the perpendicular position of FIG. 1. In FIG. 3, the baffle angle θ of the adjustable baffle 30 may be substantially 0 degrees from the plane parallel to the tangent plane of the cylindrical dryer drum 20. Alternatively stated, the adjustable baffle 30 may be 45 degrees from the position of FIG. 2. In the embodiment shown, the plane parallel to the tangent plane passes though the pivot axis P of hinge 36. In various embodiments, the baffle angle θ of the adjustable baffle may extend more or less than 90 degrees (e.g. range of movement greater or less than 90 degrees) from the position of the adjustable baffle in FIG. 1. In some embodiments, the baffle angle θ may be a first increment between two adjacent positions of the baffle 30 and may be a second increment between another adjacent baffle 30, wherein the first increment is different (e.g. smaller or larger) than the second increment.

In the embodiments shown, the adjustable baffle 30 extends inside the dryer drum along a line that is perpendicular to the ends 23, 24 of the dryer drum 20 and parallel to the longitudinal axis L1. However, it should be understood that the adjustable baffle 30 may be a variety of orientations or angles relative to a variety of structure along the cylindrical wall 22 between the open proximal or first end 23 and the opposing distal or second end 24. For example, the adjustable baffle 30 may be non-perpendicular to drum ends 23, 24 and/or have a helical arrangement and still move between one or more baffle angles θ to different positions.

In some embodiments, one or more adjustable baffles 30 may be positioned and/or orientated in a variety of positions and/or orientations around the dryer drum 20. Although three adjustable baffles 30 are spaced circumferentially about the cylindrical wall 22 and substantially extend from the opposing ends 23, 24 of the dyer drum, any number of adjustable baffles may be positioned and/or orientated between the opposing ends. For example, two adjustable baffles may extend lengthwise between the ends of the cylindrical wall 22. In some embodiments, these two adjacent adjustable baffles extending lengthwise may have substantially the same or different position and/or angle. In some embodiments, for example, only one of the two adjacent baffles may be pivoting and the other one fixed. In other embodiments, adjustable baffles may overlap for a portion of the lengthwise between dryer drum ends 23, 24.

The tilt or pivoting of one or more adjustable baffles 30 may be controlled by a variety of methods. In one embodiment, individual geared stepper motors within the adjustable baffle (e.g. the base portion) may control the baffle angle θ of one or more adjustable baffles. Moreover, if controlled by motors, electric power may be transmitted to the motors while the dryer drum 20 is rotating (e.g. rotating coupling). In various embodiments, a single stepper motor in one adjustable baffle may include linkages to connect to and control one or more additional adjustable baffles, to create similar or different pivot angles. In some embodiments or in addition thereto, the baffle angle θ of one or more adjustable baffles 30 may be manually controlled. The position of one or more adjustable baffles may be controlled based on load type, load size, cycle, desired duration of cycle, etc., to change the characteristic of the tumbling clothes or airflow optimization. In some embodiments, a controller may allow for the position of one or more adjustable baffles to be constant or varied dependent on the cycle, type and/or load size of clothes, and/or time period, etc. Although each adjustable baffle 30 may be in substantially the same angle or pivot positon within the dryer drum 20, the baffle angle θ and therefore the pivot position may be different among the plurality of adjustable baffles 30 when the dryer drum 20 is rotated.

As shown in the embodiment of FIGS. 1-5, the adjustable baffle 30 may include a base portion 32 and a blade portion 34. The blade portion 34 may pivot and/or tilt relative to the base portion 32 to a variety of positions or baffle angles θ. The pivoting of the blade portion 34 between positions may be in the same or different rotational direction as the rotational direction R of the dryer drum in some embodiments. The blade portion 34 may pivot between the first position and at least one second position about one or more hinges 36. In some embodiments, as shown, the hinge 36 may be one or more pins 39 allowing relative pivoting movement between the base portion 32 and the blade portion 34. The hinge 36 may have a pivot axis P. The pivot axis P is shown as substantially perpendicular to the rotational direction R and/or substantially parallel to the longitudinal axis L1. It should be understood the hinge 36 and pivot axis P may be angled to the rotational direction and/or longitudinal axis L1 in some embodiments. The base portion 32 may be attached to the cylindrical wall 22 of the dryer drum 20. In the embodiment shown (FIGS. 1 and 5), the blade portion 34 is hinged to opposing tabs 35 of the base portion 32 adjacent the opposing ends 23 and 24 of the cylindrical wall 22. The hinge 36 and pivot axis P may extend through the opposing tabs 35 and the proximal end 34*a* of the blade portion 34. In various embodiments, one or more blade portions 34 may be included with a base portion 32. As shown, the blade portion 34 may, for example, be generally rectangular in shape with rounded edges on the proximal end 34*a* adjacent the base portion 32 and an opposing distal end 34*b*. In various embodiments the pivot axis P may be coincidentally aligned with the longitudinal axis L1 of the dryer drum 20 and/or the longitudinal axis L2 of the adjustable baffle/blade portion 34, the distal end 34*b* of the blade portion 34 may pivot in the same or opposite direction of drum rotational direction R (e.g. clockwise or counterclockwise about the pivot P). Although the hinge 36 is adjacent the proximal end 34*a* of the blade portion 34, the hinge 36 may be a variety of positions spaced therefrom. In some embodiments, the distal end 34*b* of the blade portion 34 and/or the proximal end 34*a* or portions thereof may move about the pivot axis P. Although an embodiment of the adjustable baffle 30, blade portion, base portion, and/or hinge is shown in the figures, it should be understood that the adjustable baffle may be a variety of shapes, sizes, quantities, orientations, and constructions.

Figure 4:
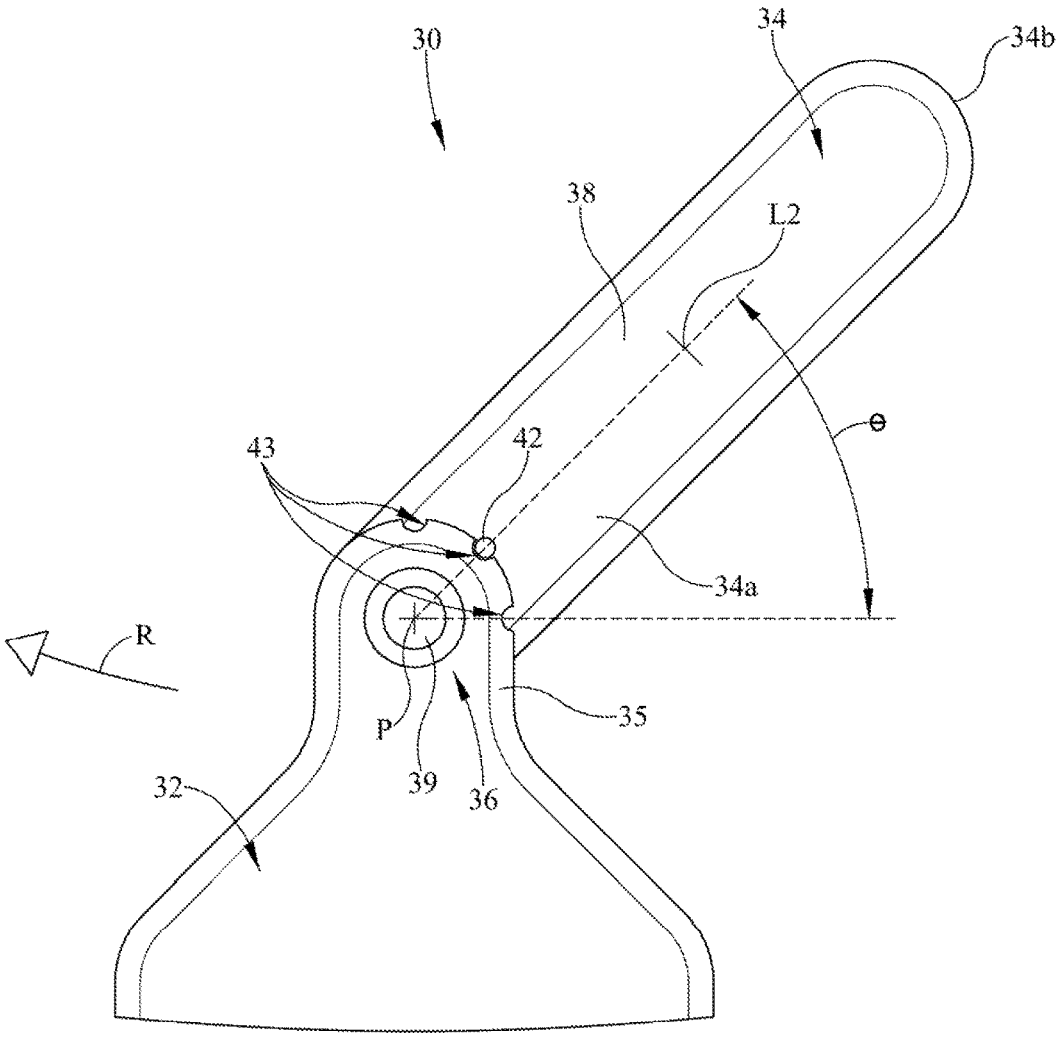
FIG. 4 is an enlarged rear view of the adjustable baffle of FIG. 2 illustrating an embodiment of a locking mechanism releasably securing the adjustable baffle in one baffle angle of about 45 degrees relative to a tangent line of the dryer drum.

The adjustable baffle 30 may be locked in one or more positions. The adjustable baffle may be locked in a position by the user manually or automatically. As shown in FIG. 4, the adjustable baffle 30 may automatically lock when in the desired position. It should be understood that a variety of locking mechanisms 40 may be used and still temporarily fix the position of the adjustable baffle 30. In the embodiment shown in FIG. 4, if used, the locking mechanism 40 may be catch, pin, or protrusion 42. The catch 42 may project from one or more ends (e.g. the proximal end 34*a*) of the blade portion 34 and engage a corresponding detent or depression 43 of a plurality of spaced detents 43 corresponding to a variety of positions and/or baffle angles θ. As shown in FIG. 4, the baffle angle θ of the position is about 45 degrees. It should be understood that the locking mechanism 40 may be a variety of constructions, quantities, etc. and still be within the scope of the invention.

Figure 5:
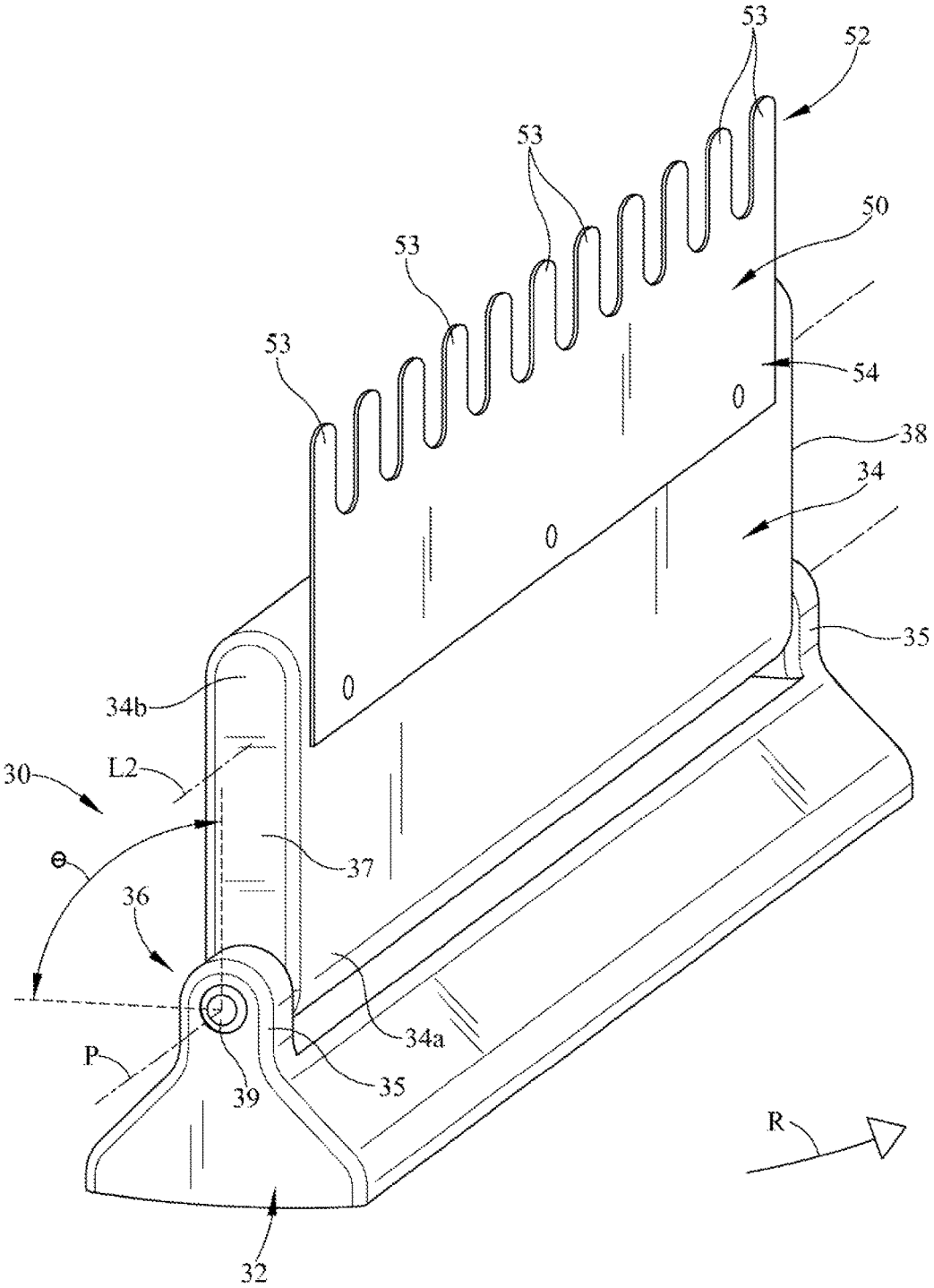
FIG. 5 is perspective view of another embodiment of an adjustable baffle, illustrating an embodiment of a flexible member attached thereto.

In addition, in some embodiments, the adjustable baffle 30 may include one or more flexible members 50. As shown in FIG. 5, the blade portion 34 includes one or more flexible members 50. The tail or free end 52 projecting from the blade portion 34 of the one or more flexible members 50 may flex more or less based upon the type of load and/or size of the load and the material of the flexible material 50. Although the flexible member 50 is shown as extending outwardly from the blade portion 34 (e.g. the distal end 34*b*) in the direction along the blade portion 34 from the proximal end 34*a* towards the distal end 34*b*, the flexible member 50 may project in a variety of directions from the blade portion 34 and still pivot with the blade portion 34 between positions. If used, in the embodiment shown in FIG. 5, the proximal end 54 of the flexible member 50 may be secured to the blade portion distal end 34*b*. In the embodiment shown, the free end 52 of the flexible member 50 may include a plurality of flexible fingers 53. The flexible member 50 may be a variety of flexible or pliable materials (e.g. silicone). It should be understood that the flexible members 50 may be a variety of constructions, materials, quantities, shapes, sizes, and orientations relative to the adjustable baffle 30 and still be within the scope of the invention. For example, in some embodiments, the flexible member may be attached to the base portion and/or the blade portion. Moreover, the one or more flexible members 50 may be attached/detached by the user as desired (e.g. for specific loads) or in some embodiments attached/detached during manufacture. For example, the flexible member 50 may be fixedly secured or releaseably secured to the adjustable baffle 30 or portions thereof. Also, different flexible members may be selected by the user and/or manufacturer and used with the adjustable baffle 30 to achieve a variety of tumbling characteristics. In some embodiments, the same or different flexible members may be attached to one or more adjustable baffles 30 to create different tumbling characteristics.

As described, in use, one or more adjustable baffles 30 may be angled or pivoted between positions. The baffle angle θ may be the same or different between adjustable baffles 30. The position may be selected by the user, may be preselected automatically for a cycle, type of load, size of load, etc., or selected based upon one or more characteristics sensed by the appliance (e.g. load type, moisture level, size of load, duration, etc.). In some embodiments, the pivot position may be constant in use, however the position of the adjustable baffle 30 may change during a cycle or load. For example, one position may be used for a duration of time and/or until one or more characteristics of the load is sensed before changing to a subsequent position for another duration of time and/or until one or more characteristics of the load is sensed. For example, in some embodiments, the baffle angle may be adjusted over the length of the cycle depending on the wetness of the clothing. Also, at the minimum angle setting, the adjustable baffle 30 may be adjusted to provide more volume.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure. In some embodiments, All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A laundry drying machine comprising:

a housing;

a dryer drum positioned within the housing, wherein the dryer drum includes a cylindrical wall;

at least one adjustable baffle attached to the cylindrical wall of the dryer drum, the at least one adjustable baffle including a base portion and a blade portion hinged to the base portion about a pivot axis, wherein the blade portion includes a longitudinal axis coincidentally aligned with the pivot axis;

wherein the blade portion is adapted to have a range of baffle angles about the pivot axis relative to the base portion, wherein the range of baffle angles includes a first position and one or more second positions; and the at least one adjustable baffle is locked in both the first position and the one or more second positions.

2. The laundry drying machine of claim 1 wherein the blade portion includes one or more flexible members projecting therefrom.

3. The laundry drying machine of claim 1 wherein the at least one adjustable baffle is at least one of manually pivoted or automatically pivoted between the first position and the one or more second positions.

4. The laundry drying machine of claim 1 includes a plurality of the at least one adjustable baffle, wherein one of the plurality of the at least one adjustable baffle is in the first position and another one of the plurality of the at least one adjustable baffle is in the one or more second positions.

5. The laundry drying machine of claim 1 further comprising one or more hinges between the base portion and the blade portion.

6. The laundry drying machine of claim 5 wherein the blade portion includes a proximal end adjacent the base portion and a distal end, wherein the one or more hinges are adjacent the proximal end of the blade portion.

7. The laundry drying machine of claim 5 wherein the dryer drum includes a first end and a second end, wherein the first end defines an opening therein, and the blade portion extends from the first end to the second end of the dryer drum.

8. A method of adjusting a baffle angle of a dryer drum baffle for a laundry drying machine, comprising the steps of:

providing a dryer drum having a cylindrical wall, wherein the cylindrical wall has a first end and a second end, wherein the first end defines an opening, and the cylindrical wall has attached thereto a plurality of adjustable baffles;

each one of the plurality of adjustable baffles includes a longitudinal axis;

pivoting one or more of the plurality of adjustable baffles relative to the cylindrical wall between a first position and one or more second positions about a pivot axis coincidentally aligned with the longitudinal axis wherein the tumbling characteristics of clothes within the dryer drum are affected by the first position or the one or more second positions of the one or more of the plurality of adjustable baffles; and locking the one or more of the plurality of adjustable baffles in both the first position and the one or more second positions.

9. The method of claim 8 wherein the step of pivoting one or more of the plurality of adjustable baffles includes at least one of manually pivoting or automatically pivoting between the first position and the one or more second positions.

10. The method of claim 8 wherein the step of pivoting the one or more of the plurality of adjustable baffles includes pivoting one of the one or more of the plurality of adjustable baffles to the first position and another one of the one or more of the plurality of adjustable baffles to the one or more second positions.

11. The method of claim 8 further comprising the step of attaching one or more flexible members to the one or more of the plurality of adjustable baffles.

12. A dryer drum for a laundry drying machine comprising:

a dryer drum having a cylindrical wall, wherein the cylindrical wall has a first end and a second end, wherein the first end defines an opening therein;

at least one adjustable baffle attached to the cylindrical wall and defining a baffle angle between the adjustable baffle and the cylindrical wall;

the at least one adjustable baffle includes a longitudinal axis between opposing ends;

wherein the at least one adjustable baffle is adjustable through a range of baffle angles about a pivot axis coincidentally aligned with the longitudinal axis of the at least one adjustable baffle between a first position and one or more second positions thereby adjusting the baffle angle, wherein the tumbling characteristics of clothes within the dryer drum are affected by the baffle angle of the at least one adjustable baffle; and wherein the at least one adjustable baffle is locked in both the first position and the one or more second positions.

13. The dryer drum of claim 12 wherein the at least one adjustable baffle includes a base portion and a blade portion, wherein the blade portion pivots about the pivot axis between the first position and the one or more second positions relative to the base portion.

14. The dryer drum of claim 13 wherein the blade portion includes one or more flexible members projecting therefrom.

15. The dryer drum of claim 12 wherein the at least one adjustable baffle is at least one of manually pivoted or automatically pivoted between the first position and the one or more second positions.

16. The dryer drum of claim 12 includes a plurality of the at least one adjustable baffle, wherein one of the plurality of the at least one adjustable baffle is in the first position and another one of the plurality of the at least one adjustable baffle is in the one or more second positions.

17. The dryer drum of claim 12 wherein the baffle angle of the at least one adjustable baffle in the first position is 0 degrees to 90 degrees relative to the cylindrical wall.

* * * * *